US008157302B1

(12) United States Patent
Webb et al.

(10) Patent No.: US 8,157,302 B1
(45) **Date of Patent: *Apr. 17, 2012**

(54) INTEGRATION OF VERTICAL ADJUSTABILITY IN AN ELECTRIC STRIKE

(75) Inventors: Michael A. Webb, Phoenix, AZ (US); Joshua T. Peabody, Phoenix, AZ (US); Scott Sullivan, Phoenix, AZ (US); Steve Whisel, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/287,631

(22) Filed: Oct. 9, 2008

Related U.S. Application Data

(63) Continuation-in-part of application No. 12/057,091, filed on Mar. 27, 2008.

(60) Provisional application No. 60/920,736, filed on Mar. 28, 2007.

(51) Int. Cl.
*E05B 15/02* (2006.01)

(52) U.S. Cl. ..... 292/341.15; 292/340; 292/341.16; 292/341.17; 292/341.19

(58) Field of Classification Search ..... 292/340, 292/341, 341.15, 341.16, 341.17, 341.18, 292/341.19
See application file for complete search history.

(56) References Cited

U.S. PATENT DOCUMENTS 4,626,000 A 12/1986 O'Leary
4,626,010 A 12/1986 Hanchett, Jr. et al.
4,867,496 A * 9/1989 Thomas ..... 292/341.16
5,257,841 A * 11/1993 Geringer et al. ..... 292/340
5,757,269 A * 5/1998 Roth et al. ..... 340/542
5,934,720 A 8/1999 Karalius
5,990,579 A * 11/1999 Ricci ..... 307/117
6,588,155 B1 * 7/2003 Theune et al. ..... 49/504
6,634,685 B2 * 10/2003 Herron et al. ..... 292/341.16
6,935,663 B2 * 8/2005 Schildwachter et al. 292/341.16
7,144,053 B2 * 12/2006 Bashford ..... 292/341.16
7,185,928 B1 * 3/2007 Liao ..... 292/341.16

(Continued)

FOREIGN PATENT DOCUMENTS

DE 10310403 A1 9/2004

(Continued)

OTHER PUBLICATIONS

Hanchett Entry Systems, Inc. "Price List for 900 Series Electric Strike," 2 pages, Jan. 1986.

(Continued)

*Primary Examiner* — Thomas A Beach
*Assistant Examiner* — Mark Williams
(74) *Attorney, Agent, or Firm* — Woods Oviatt Gilman LLP

(57) ABSTRACT

An electric strike which provides vertical adjustability of the position of the strike relative to the latch bolt in the closure with modification to the doorframe on the dust box. A ramp element on the strike housing is slidably adjustable relative to the strike housing and is securable at the time of installation to align with the center of the latch bolt. The ramp element has a channel to allow entry and exit of a latch bolt having a dead latch. A keeper engages the dead latch and maintains it in a retracted position when the closure is locked and is released when the electric latch solenoid is energized. A travel limiting foot limits rotation of the keeper so that the latch bolt may transition from the keeper to the ramp element without interference.

7 Claims, 7 Drawing Sheets

U.S. PATENT DOCUMENTS

| | | | | |
|---|---|---|---|---|
| 7,669,902 | B2 * | 3/2010 | Orbeta | 292/340 |
| 7,722,097 | B2 * | 5/2010 | Schnarr et al. | 292/341.16 |
| 2004/0061343 | A1 * | 4/2004 | Bashford | 292/341.16 |
| 2006/0226663 | A1 * | 10/2006 | Liao | 292/341.16 |
| 2007/0085354 | A1 * | 4/2007 | Hirschoff | 292/341.16 |
| 2008/0224481 | A1 | 9/2008 | Geringer et al. | |
| 2009/0072555 | A1 | 3/2009 | Holzer | |
| 2010/0038920 | A1 | 2/2010 | Tsai | |
| 2010/0078944 | A1 | 4/2010 | Hirschoff | |
| 2010/0096864 | A1 | 4/2010 | Webb et al. | |
| 2010/0116006 | A1 | 5/2010 | Huang | |
| 2010/0127518 | A1 | 5/2010 | Huang | |
| 2011/0031768 | A1 * | 2/2011 | Scheffler et al. | 292/341.16 |

FOREIGN PATENT DOCUMENTS

| | | | |
|---|---|---|---|
| DE | 102004012112 | B3 | 8/2005 |
| DE | 102005048693 | A1 * | 4/2007 |
| DE | 102007014324.0 | | 10/2008 |

OTHER PUBLICATIONS

Locksmith Ledger magazine, pp. 113-114, Feb. 1986.

The National Locksmith magazine, cover, Apr. 1986.

Locksmith Ledger magazine, p. 52, Dec. 1986.

Hanchett Entry Systems, Inc. "Installation Instructions for the 900 Series Strike," 4 pages, Feb. 1986.

Williams, Mark A., Lugo, Carlos, "Final Office Action," mailed on Sep. 28, 2010 in relation to U.S. Appl. No. 12/057,091, Alexandria, VA.

Lugo, Carlos, "Advisory Action Before the Filing of an Appeal Brief," mailed on Nov. 10, 2010 in relation to U.S. Appl. No. 12/057,091, Alexandria, VA.

Cuomo, Peter, M., Williams, Mark A., "Non-Final Office Action," mailed on Apr. 1, 2010 in relation to U.S. Appl. No. 12/057,091, Alexandria, VA.

Cumo, Peter M, Williams, Mark A, "Non-Final Office Action," dated Mar. 24, 2011 in relation to U.S. Appl. No. 12/057,091, Alexandria, VA.

Williams, Mark, "Non-Final Office Action," mailed on Sep. 7, 2011 in relation to U.S. Appl. No. 12/057,091, Alexandria, VA.

* cited by examiner

INTEGRATION OF VERTICAL ADJUSTABILITY IN AN ELECTRIC STRIKE

CROSS REFERENCE IS MADE TO RELATED APPLICATION

This application is a continuation-in-part of U.S. patent application Ser. No. 12/057,091, filed Mar. 27, 2008, of the same title, which is based on U.S. Provisional Patent Application Ser. No. 60/920,736, filed Mar. 28, 2007, of the same title.

FIELD OF THE INVENTION

The present invention relates to security devices, and more particularly, to a concealed electric operated door strike for closures using latch bolts.

BACKGROUND OF THE INVENTION

In door or closure openings it may be desirable to automatically release locks having latch bolts or guarded latch bolts from their engagement in the door frame. Latch bolts are carried by a closure such as a door and are received in a strike which is mounted in a recess in a door frame. Guarded latch bolts are comprised of two elements: a latch bolt and a dead latch or latch guard. The dead latch is located directly adjacent the latch bolt and follows the latch bolt as the door or closure swings into its frame or leads the latch bolt when the door or closure swings out of its frame upon opening. The dead latch provides added security against unauthorized entry by use of devices inserted between the frame and the door or closure to depress and thus release the latch bolt.

Electric strikes that automatically release latch bolts may allow the latch bolt to ramp out of the door frame (see U.S. Pat. No. 4,626,010) or incorporate components that pivot away from the latch bolt allowing the bolt to exit the doorframe (see U.S. Pat. No. 5,934,720). Given the nature of the design of a guarded or dead latch bolt, electric strikes that ramp out a latch bolt with the dead latch can only do so if the dead latch component is first allowed to extend into a released or unlock state prior to the latch bolt being ramped out of the doorframe. Once extended to the unlocked state, the dead latch is depressed by the retracting latch bolt. Therefore it is necessary to have ramps on both sides of the dead latch to force retraction of the dead latch by ramping the latch bolt back into the door.

Normal electric strikes of the type that ramp the latch bolt back into the door or closure do not provide allowance for vertical adjustment to align the strike with the centerline of the latch bolt contained in the door. A problem occurs when a door or closure does not properly align with the doorframe causing the misalignment of the door/dead latch with the electric strike resulting in an ineffective or an inoperative strike locking system.

The present invention allows the installer of the strike to achieve vertical alignment of the strike center to the latch bolt and dead latch by a simple adjustment mechanism. The addition of dual ramps (on the strike plate and in the housing) facilitate a smooth and rapid egress of the latch from the strike during the unlocking operation of the strike. Vertical adjustability is achieved by an electric strike body having a housing faceplate, keeper and associated components common to an electric strike and further including a slotted ramp which is adjustable along the strike body and securable at a selected position. The term "vertical adjustability" is used as most enclosures such as doors are vertically mounted. However, it will be apparent that the adjustability features of the invention are applicable to installations in which the closure is non-vertical.

BRIEF SUMMARY OF THE INVENTION

The present invention achieves vertical adjustability of the effective vertical centerline of the strike relative to the latch bolt and provides a ramp having a selected egress angle for the latch bolt. The ramp is slotted and is adjustable on the strike body to provide proper clearance for the dead latch when it moves away from the strike cavity as the associated latch bolt proceeds up the ramp. The benefit of the present invention includes: (1) easier installation (no modification to the doorframe or dust box is required); (2) added adjustability; and (3) ramp features that facilitate dead latch and latch bolt egress from the strike body. Without incorporation of vertical adjustability in an electric strike of a concealed type, the frame and door dead latch must align within the tolerance of the design specifications. The ability to compensate for vertical misalignment between the latch bolt, dead latch and the strike body will facilitate installation in the manner mentioned above by eliminating rework or modification of the doorframe and/or dust box. A secondary ramp with a slot for the dead latch is designed as a separate movable element and acts as an egress or exit feature for the bolt as well as providing an effective means to align the clearance gap provided for the dead latch. The vertically adjustable ramp also allows for any mismatch between the strike body and the door latch bolt and dead latch prior to the installation of the strike.

The ramp of the present invention can be used in conjunction with specially designed electric strikes providing additional benefits and features or may be used with standard electric strikes known in the art.

It is the object of the present invention to provide a new and useful means to align the horizontal centerline of the guarded latch pathway in a dual ramping faceplate of an electric strike with the centerline of the latch bolt. Another object of this invention is to provide a compact electric strike that may be installed without modification in the doorframe or dust box of a door having standard ANSI 4 ⅞" metal frame or ANSI/BHMA A 156/115-W metal frame.

Another object to this invention is to provide a compact electric strike design that will minimize the installation process for a standard aluminum frame, by requiring no modification or cutting of the doorframe face, or lip, during installation.

Another object to this invention is to provide a compact electric strike design that will minimize the installation process for a wood frame, commercial or residential, by requiring no modification or cutting of the doorframe face, or lip, and/or door molding during installation.

Another object to this invention is to provide a compact electric strike design that will minimize the installation process for a standard door mullion, fixed or removable, by requiring no modification or cutting of the mullion face, or lip, during installation.

BRIEF DESCRIPTION OF THE DRAWINGS

The above and other advantages and objects of the present invention will become more apparent in the following description, claims and drawings in which:

The same numerals are used throughout to designate the same or similar components with a letter appended in some cases for delineation.

DETAILED DESCRIPTION OF THE DRAWINGS

To release a latch bolt equipped with a dead latch, the electric strike must first release the dead latch to allow the latch bolt to become depressed into the door. The strike must also provide a pathway or slot to allow the extended dead latch to pass without interference as the door opens. To function properly, the electric strike, the dead latch and the latch bolt must be in proper vertical alignment.

It is common that door and frame installations for the door and frame are not installed perfectly square and aligned on center, thus causing the horizontal centerline of the latch bolt and strike to be misaligned as much as ¼" above the centerline or ¼" below the centerline of the strike. This situation can be further compounded by door sag in the frame occurring after installation.

Figure 6:
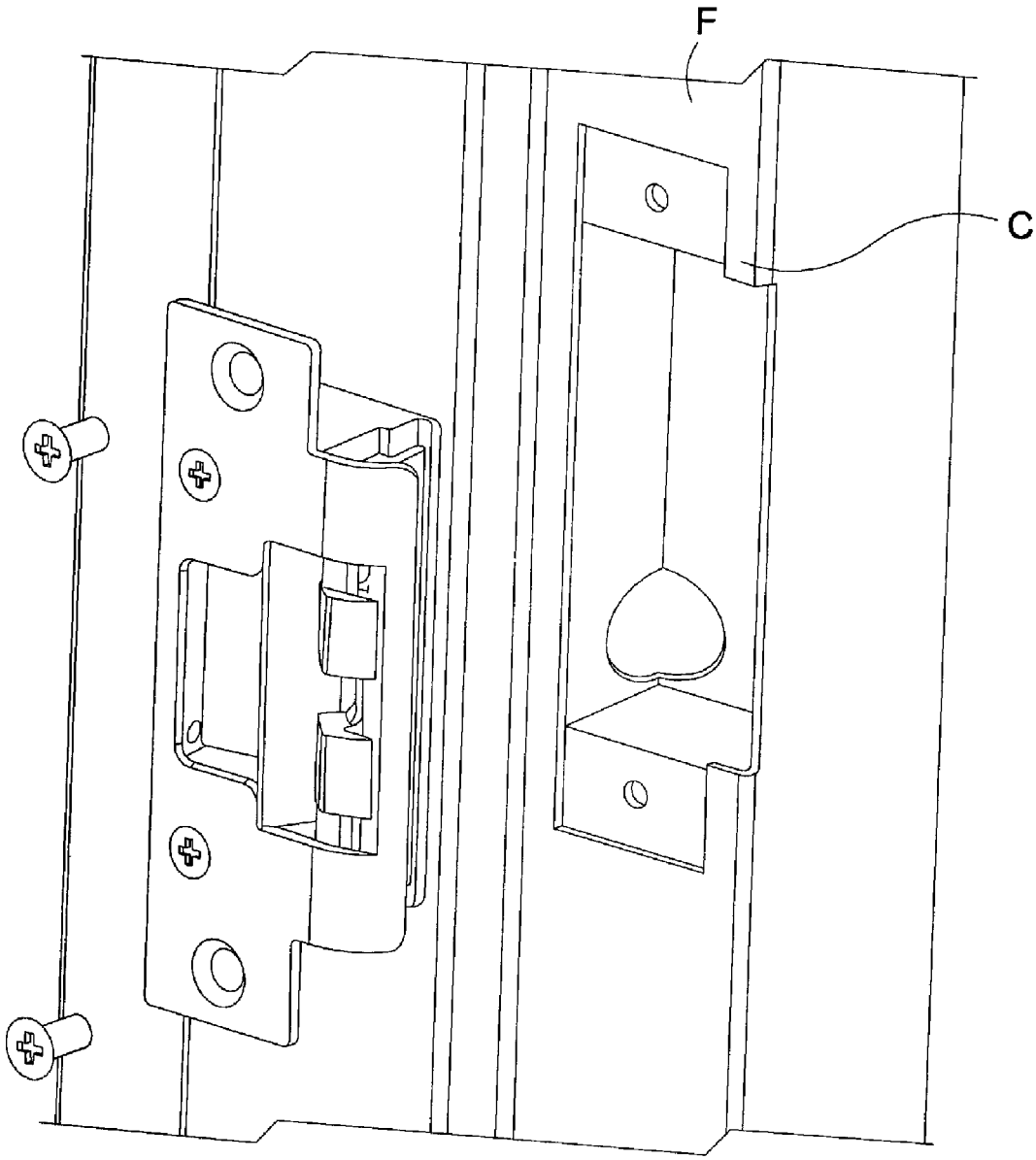
FIG. 6 illustrates the electric strike according to the present invention and an unmodified door jamb capable of receiving this strike without further modification.
Figure 7:
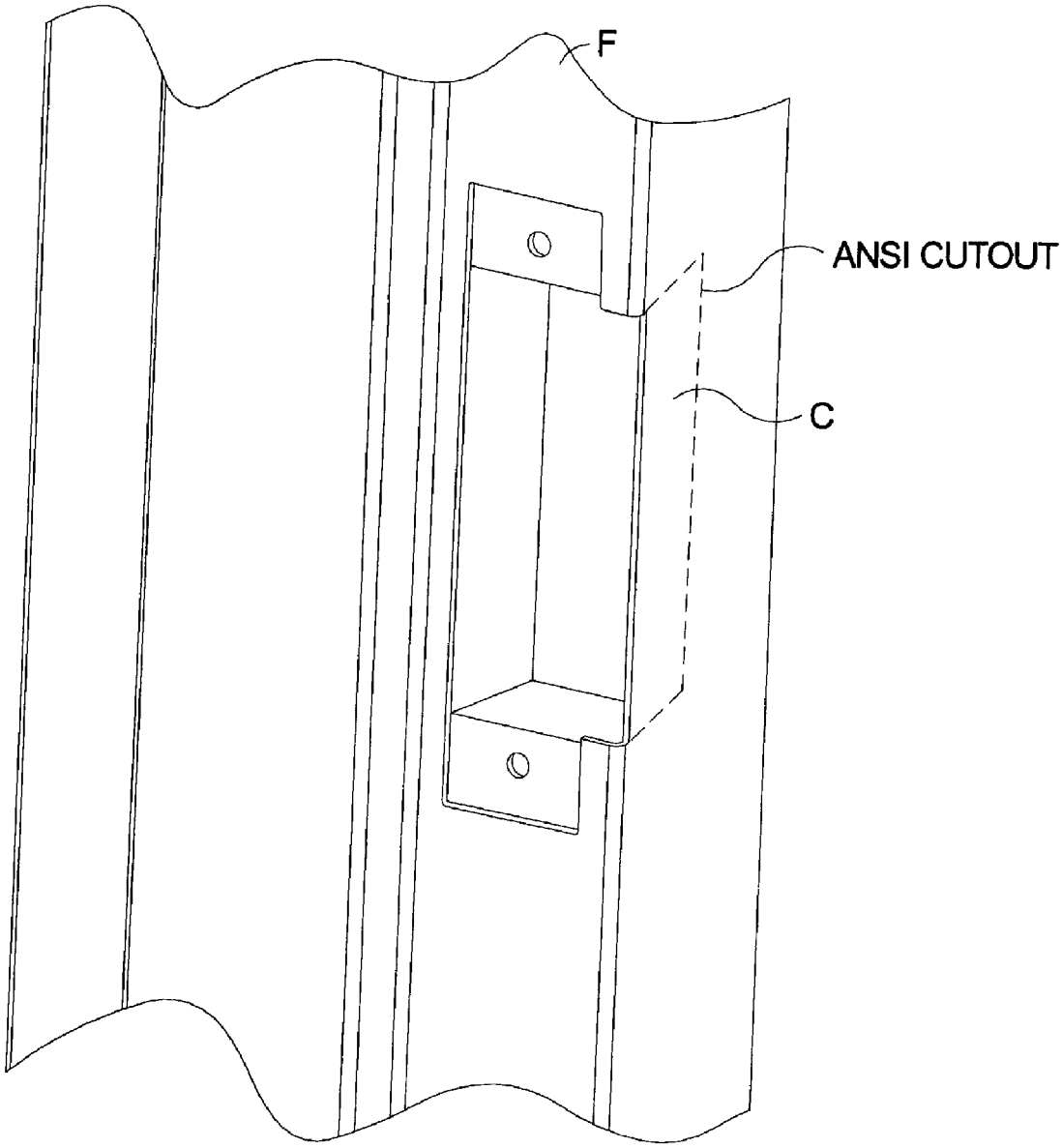
FIG. 7 illustrates the standard frame prep for a metal frame to be used with standard electric strikes.

The present invention provides an adjustment to facilitate installation and ramping to accommodate bolt egress upon opening without involving modification to the doorframe and/or dust box. FIGS. 7 and 6 represent generally necessary frame preparations for standard electric strikes and those modifications which are avoided by the present invention, respectively. The frame and dust box F is provided with a recess or cutout C to accept an electric strike which cutout may conform to a standard such as prescribed by ANSI.

Figure 3:
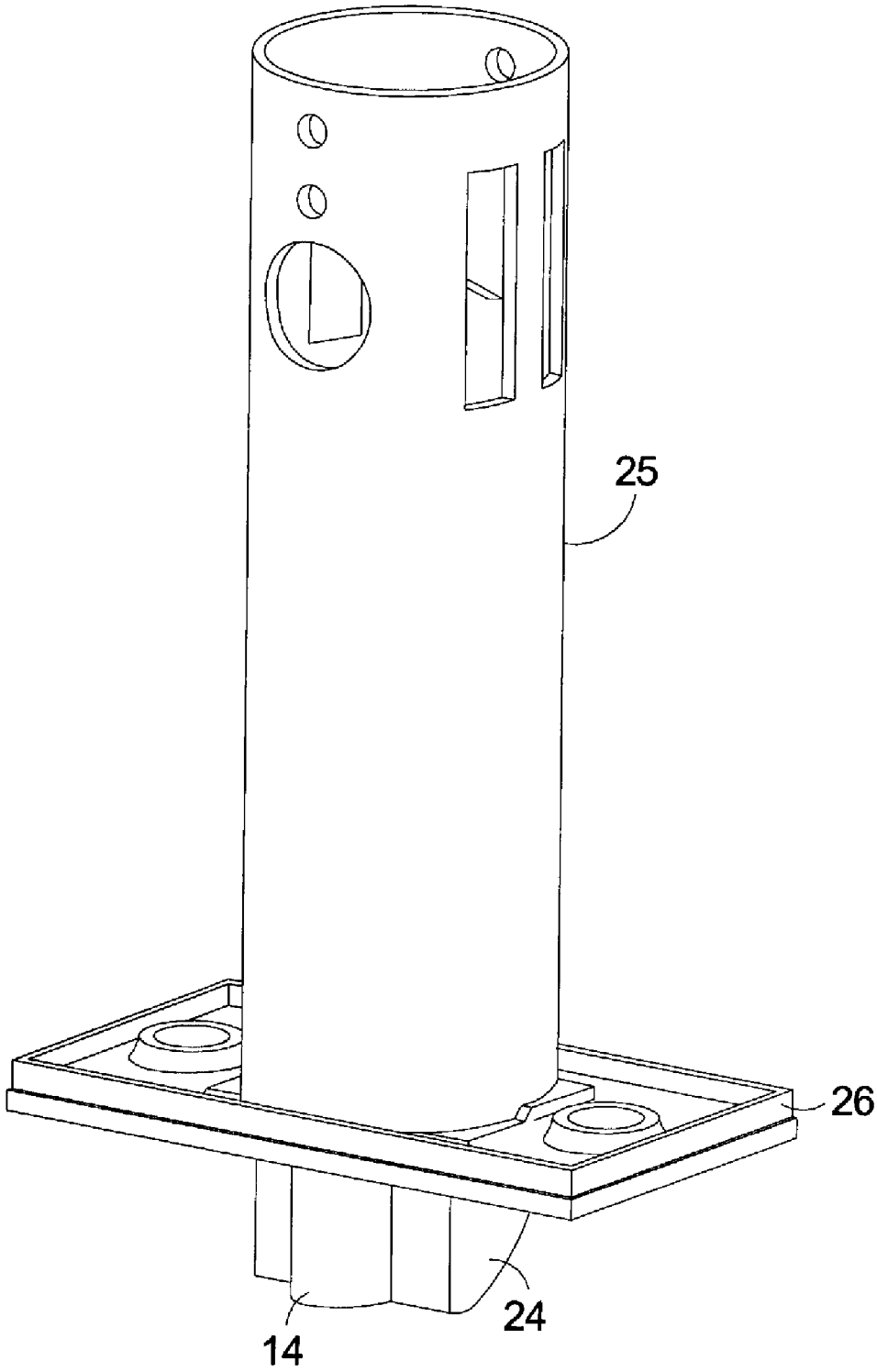
FIG. 3 is a perspective view of a representative latch bolt assembly having a dead latch.
Figure 4:
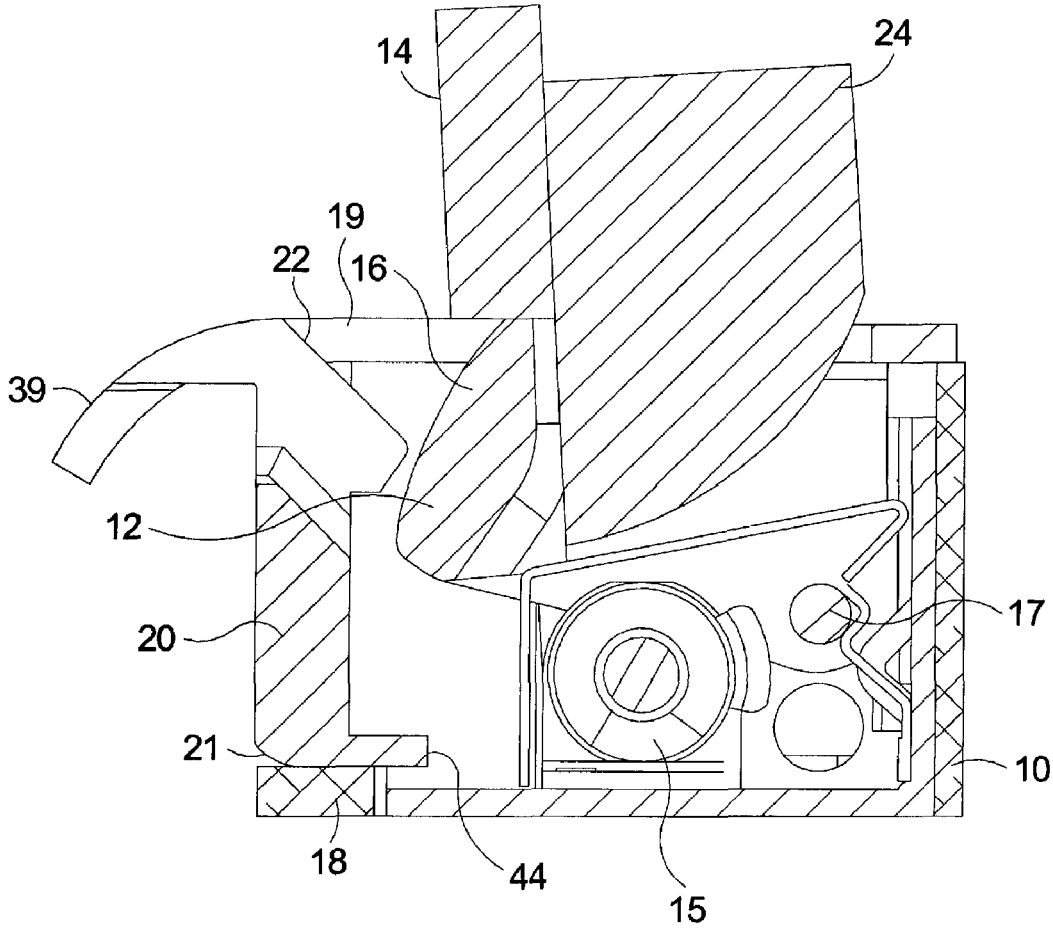
FIG. 4 is a cross sectional view showing the ramp secured to an exterior wall of the strike housing with the keeper engaging the latch bolt in a locked condition and the dead latch retracted to further secure the latch bolt.

Turning now to the drawings, particularly FIGS. 1 to 5, an electric strike housing 10 contains a keeper 12 and associated components such as a solenoid 15, and gears or links that operate the electric strike as known to those skilled in the art. The keeper 12 engages the dead latch 14 of the latch assembly 25 and is released by solenoid 15 through a gear or linkage. The keeper 12 is pivotally mounted at pivot 17 having an arm 16 which maintains the dead latch 14 in a retracted position when the door is locked as seen in FIG. 4. The keeper 12 is rotated to allow the dead latch 14 to extend when the solenoid 15 is energized. The keeper 12 has a generally planar ramp surface 13 along which the latch bolt 24 travels as the door or closure is opened.

The electric strike housing 10 has a sidewall 18 which is cut away below the faceplate 19 to receive the ramp element 20. The faceplate 19 has a latch bolt receiving opening 38 and a downwardly curved lip or ramp 39. A ramp element 20 has an elongated body which contains a channel 30 and a keeper travel limiting foot 44. The ramp element 20 is slidably received on edge 21 of sidewall 18 and is adjustable relative to housing 10 and faceplate 19. Preferably the faceplate and housing are fabricated in accordance with applicable specifications such as ANSI/BHMA A 156. 115-2006 or ANSI/BHMA 156.115-W-2006.

Figure 5:
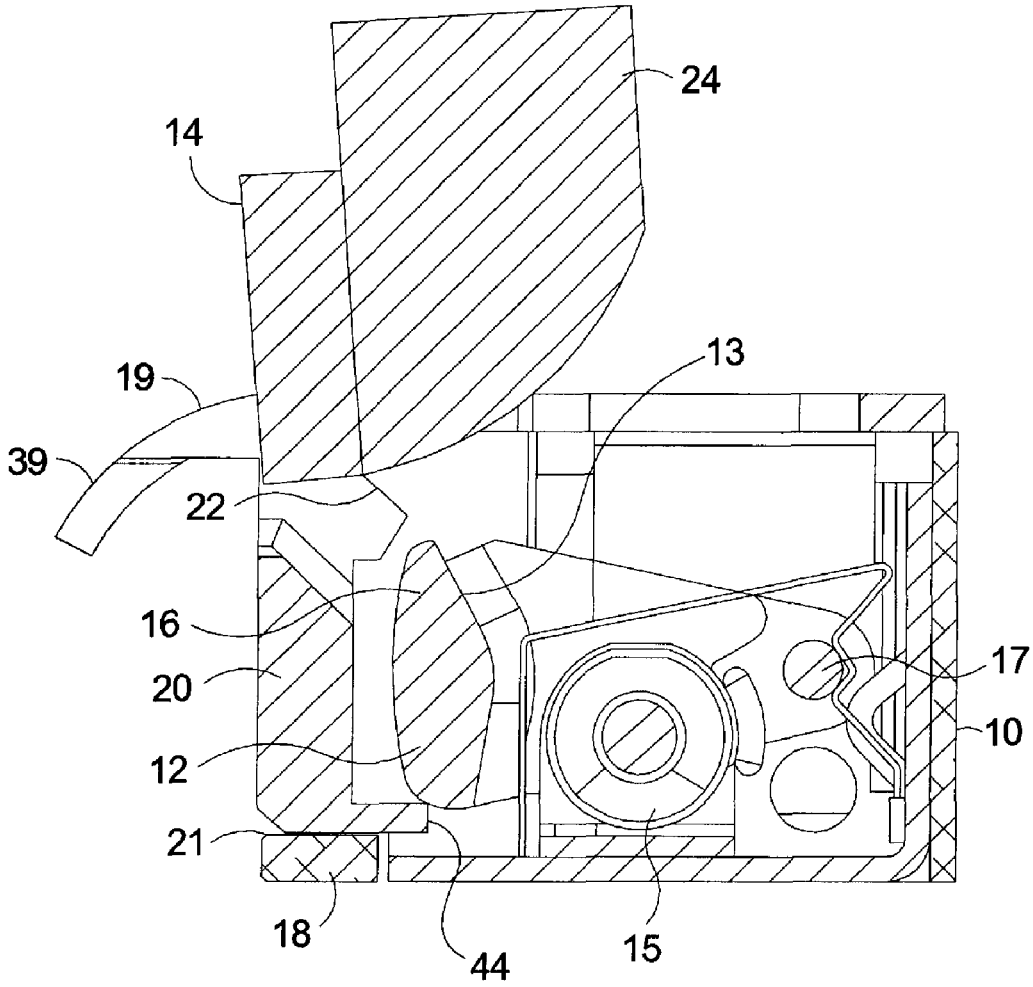
FIG. 5 is a view similar to FIG. 4 with the keeper released and moved to an unlocking position and in step down position with the secondary ramp, and with the dead latch extended to allow the latch bolt to move up the ramp.

A latch bolt 24 and dead latch 14 form a latch assembly 25 having a faceplate 26, as shown in FIG. 3, which mounts in the edge of a door or closure. Ramp element 20 has a ramp surface 22 having a planar profile. The planar region 22 defines an angle of between 30° and 45° with respect to the surface of faceplate 19. This angle is critical to proper operation. Keeper 12 and ramp element 20 must meet with a step down effect as seen in FIG. 5. This step down is assured by keeper travel limiting foot 44 which stops the rotation of keeper 22 at a point where the latch bolt may transition from the keeper to the ramp element 20 without interference. The ramp element 20 ramps or depresses the latch bolt into the door or closure as the door or closure continues to move to an open position. A vertically adjusted slot channel 30 is provided in ramp element 20. When channel 30 is properly aligned with the dead latch 14, a pathway through which the extended dead latch may travel is provided.

Figure 1:
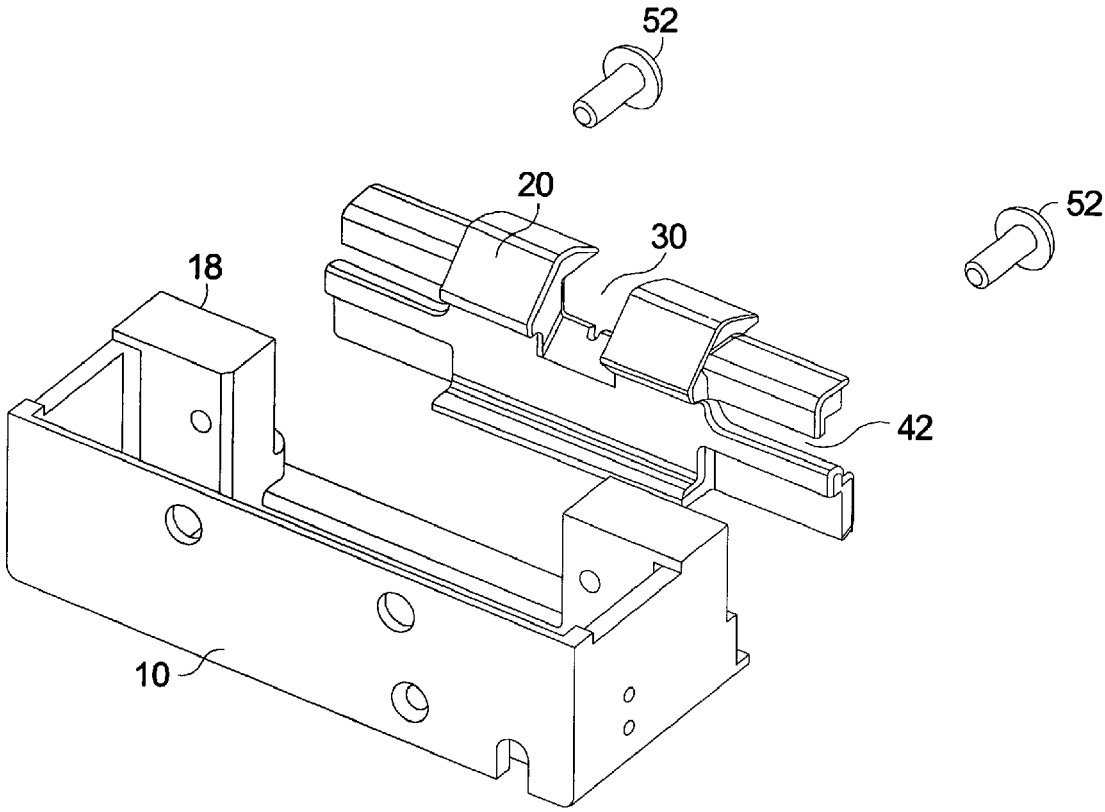
FIG. 1 is an exploded, perspective view showing the electric strike housing and the adjustable secondary ramp according to the present invention.
Figure 2:
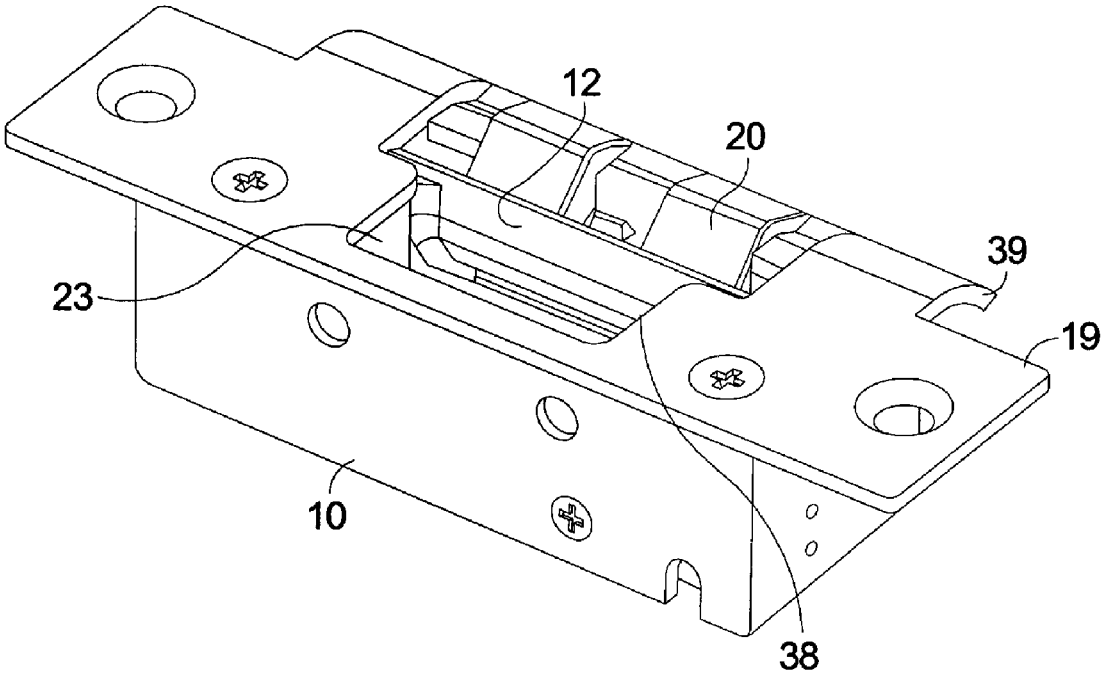
FIG. 2 is a perspective view which shows the adjustable secondary ramp positioned on the strike housing with the face plate attached.

The ramp element 20 may be adjustably securable in place on the strike housing sidewall 18 by various types of fastening arrangements. One arrangement is shown in FIG. 1 in which screws 52, through the slots 42 in the flange of the ramp element 20 firmly attach the ramp element 20 to the strike housing sidewall 18 once the ramp element 20 has been properly positioned on the sidewall to align with the bolt and the strike installed in the door frame. This arrangement permits adjustment of the vertical location of the channel 30. To cover the full range of vertical adjustment that may be required, the width of channel 30 is selected to be appropriately greater than the width of the dead latch which must pass through it.

The ramp element 20 contains a channel 30 at an intermediate location which, when the ramp is installed, aligns with the center of the bolt of a non-guarded latch bolt or with the dead latch of a guarded latch bolt. The channel 30 allows a dead latch to pass through as the door or closure is opened.

Various arrangements for adjustability securing the ramp element 20 to the housing 10 will be apparent to those skilled in the art.

The faceplate 19 is designed to allow the latch bolt 24, with or without a guarded latch 14, to ramp over the leading edge of ramp 39 upon contact, during closing of the door or closure, depressing the latch bolt 24 into the door and then releasing the latch bolt into the housing cavity 23, thus holding and securing the latch bolt and door or closure in the closed position.

This invention utilizes the basic ramping features found on ramp 39 of the faceplate 19 for closing and securing the door or closure, and further incorporates a ramping feature in the strike housing cavity 23 to ramp and depress the latch bolt 24 back into the door or closure when opening the door or closure. Dual ramping, front ramping face 39 for closing and interior ramps on keeper 12 and on ramp element 20 for opening, by itself will not retain the latch bolt 24 and door in a secured condition. However, when coupled with the latch bolt 24-dead latch guard 14 linkage in the lock set 25 of the door or closure and the keeper arm 16 of the electric strike, the dead latch 14, and the latch bolt 24 will hold the door or closure securely in the closed and locked position.

Operation

Referring to FIGS. 4 and 5, a cross-section of the electric strike is shown. Ramp element 20 is adjustably mounted on the strike housing sidewall 18 to properly align with the latch bolt and dead latch by a fastening arrangement, as has been previously described. When the door or closure is closed the latch bolt 24 will first encounter the ramp 39 on the strike plate and will be depressed. The latch bolt 24 will drop or extend into a captured position in the strike housing cavity 23, as seen in FIG. 4, and the dead latch 14 will be engaged by the keeper 12 to maintain it in a retracted position to prevent the bolt 24 from being forced external means into the retracted, unlocked position.

When the electric strike is actuated to an unlocked condition, the keeper 12 will rotate to the position shown in FIG. 5 allowing the dead latch 14 to fully extend placing it in a position which will allow the latch bolt 24 to be uninhibited from retracting into the door. When the door or closure is opened the tip of the latch bolt will initially pass over the keeper ramp surface 13 and transition onto ramp surface 22 of the ramp element 20. The ramp surface 22 is generally planar and is disposed at an angle of between 30 and 45°.

The keeper arm 16 aligns with slot 30 in the ramp element 20. Accordingly, the planar surfaces of the keeper ramp 13 and ramps 22 and 39 are relatively positioned as the latch bolt passes from the keeper 12 to the ramp element 20 and from the ramp element 20 to the strike plate 19 to facilitate smooth passage of the bolt, providing a step down effect to prevent the bolt from hanging up. The keeper ramp surface 13 aligns with surface 22 of the ramp element 20 in the open position, as shown in FIG. 5, having an angular orientation between 30 and 45°. Keeper rotation limiting foot 44 ensures that a smooth transition between keeper ramp surface 13 and ramp surface 22 will occur.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. An electric strike for a door or closure having a latch bolt with a dead latch having a first retracted locked position and a second extended unlocked position, said strike comprising:

(a) a housing having a sidewall, said housing defining a strike cavity;

(b) a faceplate including a latch bolt receiving opening and a first ramp configured to be engaged by the latch bolt, said faceplate configured for being disposed on said housing;

(c) a ramp element including a ramp surface and a channel defined in an intermediate location in said ramp surface, said ramp element is configured to be engaged with said sidewall of said housing and said ramp element is selectively positionable with respect to said housing such that a position of said channel with respect to the housing is adjustable to a selected position when selectively positioning said ramp element with respect to said housing, thereby allowing that the dead latch to pass through said channel when the door is being opened from a closed position;

(d) a fastener for securing said ramp element to said sidewall of said housing after said channel is adjusted to said selected position and after said faceplate is disposed on said housing, and wherein said fastener is accessible from an outside of said housing after said faceplate is disposed on said housing, wherein said ramp element defines an opening for receiving said fastener for adjustably securing said ramp element to said sidewall of said housing; and (e) a keeper rotatable in said housing configured to selectively release said latch bolt from said latch bolt receiving opening, said keeper having a first position retaining the dead latch in the first retracted locked position and actuable to a second position to allow the dead latch to extend to the second extended unlocked position.

2. The electric strike for a door or closure having a latch bolt with a dead latch of claim 1 wherein said keeper has a keeper ramp surface, wherein said keeper ramp surface engages the latch bolt when said keeper is in said second position, and wherein said keeper ramp surface is aligned with said ramp surface of said ramp element providing a shingling effect to facilitate the smooth passage of the latch bolt from said keeper ramp surface onto said ramp surface of said ramp element as the closure is opened.

3. The electric strike for a door or closure having a latch bolt with a dead latch of claim 1 wherein said ramp surface of said ramp element has a generally planar entry region disposed at an angle of between 30° and 45° relative to said faceplate.

4. The electric strike for a door or closure having a latch bolt with a dead latch of claim 2 wherein said keeper ramp surface is disposed at an angle of between 30° and 45°.

5. The electric strike for a door or closure having a latch bolt with a dead latch of claim 1 wherein said opening defines a slot.

6. The electric strike for a door or closure having a latch bolt with a dead latch of claim 1, wherein the ramp element has a foot engageable with said keeper to limit the rotation of said keeper at said second unlock position.

7. The electric strike for a door or closure having a latch bolt with a dead latch of claim 1 wherein said sidewall of said housing defines a cut-out below said faceplate having an edge and the ramp element is slidably adjustable along said edge.

* * * * *